US008196852B2

(12) United States Patent
Blaszczak

(10) Patent No.: US 8,196,852 B2
(45) Date of Patent: Jun. 12, 2012

(54) TRIANGULAR CRANK

(75) Inventor: Greg Blaszczak, Hummelstown, PA (US)

(73) Assignee: Ames True Temper, Inc., Camp Hill, PA (US)

( * ) Notice: Subject to any disclaimer, the term of this patent is extended or adjusted under 35 U.S.C. 154(b) by 331 days.

(21) Appl. No.: 12/558,648

(22) Filed: Sep. 14, 2009

(65) Prior Publication Data

US 2011/0062272 A1 Mar. 17, 2011

(51) Int. Cl.
*B65H 75/30* (2006.01)

(52) U.S. Cl. ..... 242/395; 242/405.2; 242/405.3; 137/355.26

(58) Field of Classification Search ..... 242/395, 242/395.1, 405.2–405.3; 74/543–545; 137/355.26–355.27
See application file for complete search history.

(56) References Cited

U.S. PATENT DOCUMENTS

| | | | | | |
|---|---|---|---|---|---|
| 4,706,906 | A | * | 11/1987 | Roman et al. | 242/401 |
| D299,618 | S | * | 1/1989 | Drought et al. | D8/359 |
| D503,837 | S | * | 4/2005 | Alkalay | D34/14 |
| D570,573 | S | * | 6/2008 | Arcati et al. | D34/24 |
| D604,019 | S | | 11/2009 | Blaszczak et al. | |
| D604,021 | S | | 11/2009 | Blaszczak et al. | |
| 2010/0242667 | A1 | * | 9/2010 | Kolowinski et al. | 74/544 |

* cited by examiner

*Primary Examiner* — Sang Kim
(74) *Attorney, Agent, or Firm* — Eckert Seamans Cherin & Mellott, LLC; David C. Jenkins

(57) ABSTRACT

A crank assembly for a hose reel is provided. The crank includes an axle rod and a triangular frame assembly. The axle rod extends perpendicular to the triangular frame assembly. The axle rod extends from the medial portion of on of the three tubular members. In this configuration, and when the crank is in use, force is distributed to opposing sides of the axle rod. Further, the triangular shape provides a support for a flat plate upon which an indicia may be displayed.

20 Claims, 3 Drawing Sheets

TRIANGULAR CRANK

BACKGROUND OF THE INVENTION

1. Field of the Invention

This invention relates to hose reels and, more specifically, to a triangular metal crank assembly for a hose reel.

2. Background Information

Hose reels are used to store and transport hoses, typically garden hoses. The hose reel is coupled to a water supply by a supply, or leader, hose. The supply hose is in fluid communication with the garden hose. The garden hose is wound about a rotatable basket disposed on a hose reel frame. The hose reel frame, as well as the basket, are typically made from substantially either plastic or metal. Each of these materials have advantages and disadvantages.

For example, a plastic hose reel typically includes a large hub that is coupled either directly or via a gear assembly to the basket. These elements may be difficult to mold and typically occupy a large amount of space prior to assembly of the hose reel. A plastic hose reel also typically includes several generally flat members or panels wherein the manufacturer/seller may display a logo or other trademark. A metal hose reel, on the other hand, typically comprises a plurality of tubular members which, prior to assembly, may be stored in a relatively small space. The tubular metal elements, however, are subject to fatigue. Metal fatigue typically effects the curved portions of metal hose reel cranks. That is, metal hose reel cranks are typically formed from a tubular rod that is bent so as to include opposing perpendicular ends extending from a medial portion, i.e. a "Z" shape but with substantially right angles. This shape, while easy to manufacture, is prone to fatigue at the bends. This is especially true when a user winds a hose that is filled with water. That is, while such cranks are designed to bear the force associated with winding an empty hose, users often fail to drain the hose prior to winding. Thus, when a user winds a hose full of water, the crank is expose to a higher than expected stress which, in turn, causes fatigue at the bends in the crank. Generally, the area prone to fatigue is at the end of the crank where it connects to the reel. The longer the crank, the larger the moment and stress at that point and the higher the probability of failure (especially fatigue failure overtime). There is also an increased amount of flexing that makes cranking uncomfortable and, on steel hose reels, contributes to hardening of steel through cold working. This makes the crank brittle and even more susceptible to failure/cracking at the connection point. Moreover, such tubular metal elements, on both the frame assembly and the crank, provide a limited area on which to display logos or other trademarks.

SUMMARY OF THE INVENTION

The disclosed and claimed concept relates to a crank assembly for a hose reel and, more specifically, to a triangular crank assembly for a hose reel. It is noted that one method of reducing the effort required to bring in a hose would be to simply increase the length of the crank arm. It is noted, however, that the longer the crank, the shorter the time till fatigue failure occurs unless the crank is significantly reinforced (more material is used and more welds at the connection point to the reel). The triangular design of the provided crank assembly allows the area of attachment to have two contact points instead of just one. Thus, the moment created when force is applied to the crank, as well as the associated stress, is reduced by half. This, in turn, transfers stress into the reel frame or basket, which by design is already much stronger than the crank. The triangular shape also makes the crank much stiffer, which reduces cold working effects.

The crank is for a metal hose reel and, as such, is made substantially from tubular metal elements. These elements include an axle rod and a triangular frame assembly. The triangular frame assembly includes three tubular members. The axle rod extends perpendicular to the triangular frame assembly. Moreover, the axle rod extends from the medial portion of one of the three tubular members. In this configuration, and as noted above, when the crank is in use, the force is distributed to opposing sides of the axle rod. This reduces the metal fatigue at the intersection of the crank arm and the axle rod. Further, the triangular shape provides a support for a flat plate upon which an indicia, such as, but not limited to, a logo or other trademark may be displayed.

It is noted that the display of a logo or other trademark does not effect the operation of the hose reel and, as such, is not a significant benefit to the user. The display of a logo or other trademark is, however, a great advantage to the manufacturer/seller of the hose reel. Typically, one of each type of hose reel are displayed in an assembled state in hardware stores and garden centers. The hose reels to be purchased are typically unassembled and boxed on an adjacent self. Thus, a shopper who is impressed with a particular hose reel may easily match the displayed logo or other trademark to the corresponding unassembled and boxed hose reel having the same logo or other trademark.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, a "crossbar" is a rigid member that extends perpendicular, or substantially perpendicular, to an axis of rotation. Further, a "crossbar" is at least partially bifurcated by an axle or a member aligned with an axle.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body.

As used herein, directional terms, such as, but not limited to, "front," "back," "right," "left," "upper," "lower," and correspond to the orientation of the hose reel or crank assembly as shown in the Figures and are not limiting on the claims.

As used herein, "correspond" indicates that two structural components are sized to engage each other with a minimal gap, partial gap, or no gap therebetween. Thus, an opening which corresponds to a member is sized slightly larger than the member so that the member may pass through the opening.

Figure 1:
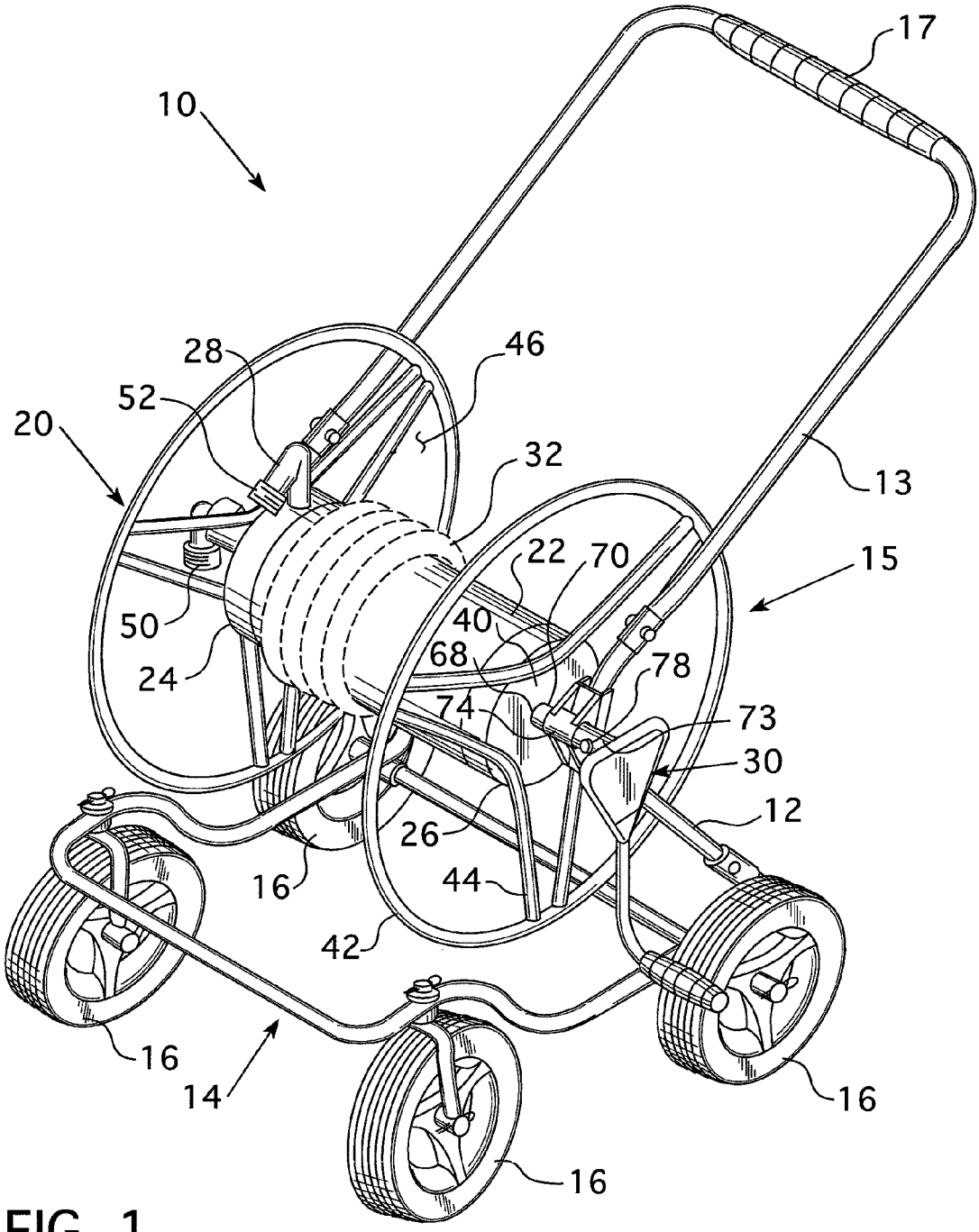
FIG. 1 is an isometric view of a hose reel.
Figure 2:
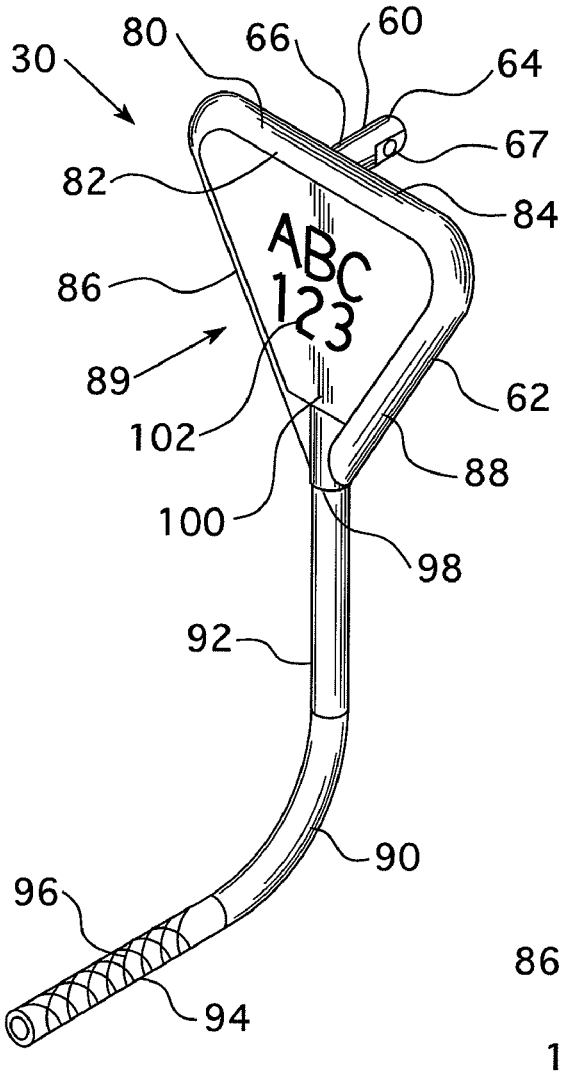
FIG. 2 is an isometric view of the crank assembly.
Figure 3:
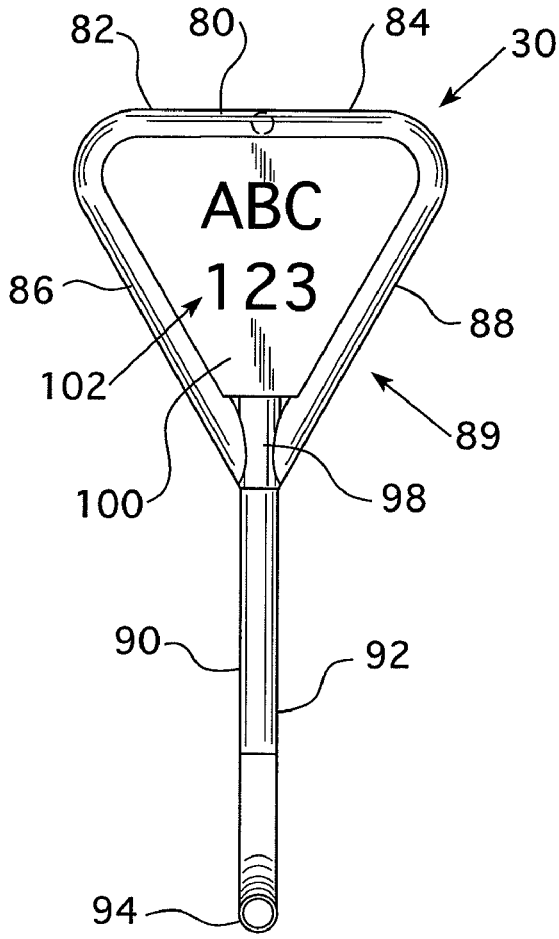
FIG. 3 is a front view of the crank assembly.
Figure 4:
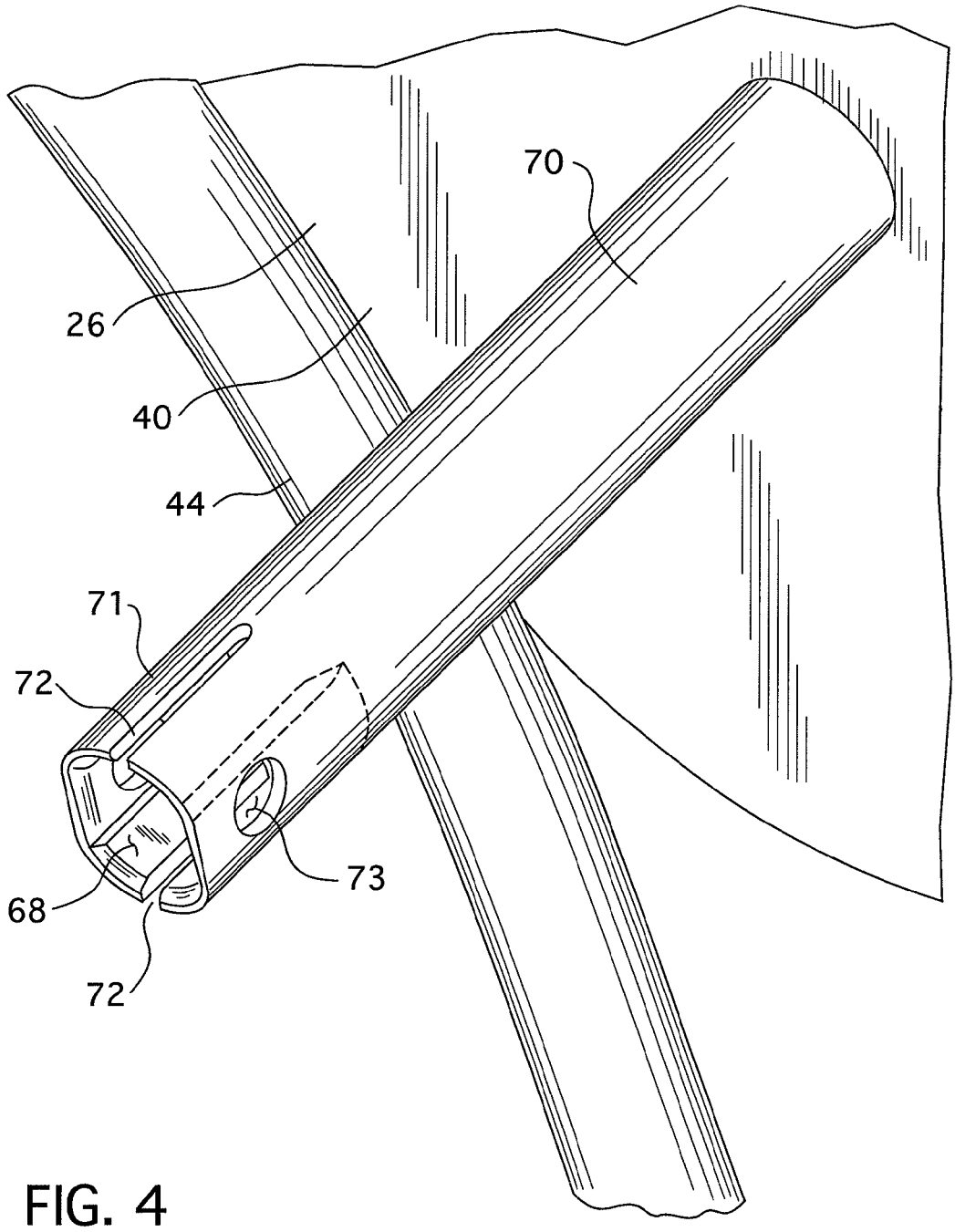
FIG. 4 is a detailed isometric view of the crank hub axial extension.

As shown in FIG. 1, a hose reel 10 includes a frame assembly 12 and a basket assembly 20. The frame assembly 12 includes plurality of tubular members 13, preferably metal tubular members. The frame assembly 12 includes a lower portion 14 and an upper portion 15. The frame assembly lower portion 14 is structured to be coupled to, and supported by, a plurality of wheels 16. The frame assembly upper portion 15 is structured to rotatably support the basket assembly 20 and may form a handle 17 that extends above the basket assembly 20.

The basket assembly 20 includes a barrel 22, a pair of hubs 24, 26, a water conduit assembly 28 and a crank assembly 30. The barrel 22 is generally cylindrical member structured to have a hose 32 wrapped thereabout. Preferably, the barrel 22 has a diameter that is substantially greater than the hose 32. The pair of hubs 24, 26 includes a water conduit hub 24, through which the water conduit assembly 28 extends, and a crank hub 26, to which the crank assembly 30 is coupled. Each hub 24, 26 includes an inner member 40, an outer rim 42, and a plurality of spokes 44. Each hub inner member 40 is fixed to an end of the barrel 22. The spokes 44 extend from the hub inner member 40 to the associated hub outer rim 42. The hub outer rims 42 are preferably circular and define a hose storage space 46 therebetween. Alternately, the hubs 24, 26 may be large disks (not shown) which combine the function of the hubs 24, 26 and outer rims 42. The hubs 24, 26 are rotatably coupled to the frame assembly 12. Thus, the basket assembly 20 and/or the barrel 22 are structured to rotate relative to the frame assembly 12.

The water conduit assembly 28 includes a stationary end 50 and a rotating end 52. The water conduit assembly 28 stationary end 50 and rotating end 52 are in fluid communication with each other. The water conduit assembly stationary end 50 extends from the water conduit hub 24 and is disposed along the axis of rotation of the barrel 22. Although part of the basket assembly 20, the water conduit assembly stationary end 50 does not rotate. The water conduit assembly stationary end 50 is structured to be coupled to, and be in fluid communication with, a supply hose (not shown). The water conduit assembly rotating end 52 extends from the barrel 22 and is structured to be coupled to, and in fluid communication with, the hose 32. The water conduit assembly 28 includes a rotating coupling (not shown) within the barrel 22 that allows the water conduit assembly rotating end 52 to rotate with the barrel 22.

Thus, the hose reel 10 may be used to wind a hose 32 about the rotatable basket assembly 20 and/or the barrel 22. When a user desires to use the hose 32, the user simply pulls the hose 32 and the basket assembly 20 freely rotates while releasing the hose 32. To wind the hose 32 around the basket assembly 20 and/or the barrel 22, the user utilizes the crank assembly 30.

The crank assembly 30 includes an axle rod 60 and a crank frame assembly 62. The axle rod 60 is an elongated member having a first end 64 and a second end 66. The axle rod first end 64 is coupled to the crank frame assembly 62 as described below. The axle rod second end 66 is structured to be fixedly coupled to the crank hub 26. This may be accomplished, as shown, by having a non-circular opening 68 at, or substantial near, the center of the crank hub 26 and providing the axle rod second end 66 with a corresponding shape. As shown, the crank hub opening 68 and the axle rod second end 66 have a cross-sectional shape that is a generally circular, but which has two flat portions. Further, as shown, the crank hub opening 68 is disposed on a crank hub axial extension 70, which is a hollow tube, having a distal end 71. The crank hub axial extension distal end 71, which defines the crank hub opening 68, may include one or more longitudinal slots 72 that allow the crank hub axial extension distal end 71 to flex thereby allowing the crank hub opening 68 to increase its cross-sectional area. The axle rod second end 66 and the crank hub axial extension distal end 71 may have openings 67, 73 (respectively) that define a passage for a fastener 78, such as, but not limited to a bolt and nut.

It is noted that either a medial portion of the axle rod 60 and/or a medial portion of the crank hub axial extension 70 is generally circular and extends through a circular opening, shown as a hoop bracket 74, on the frame assembly 12. This hoop bracket 74 provides the rotatable coupling between the basket assembly 20 and the frame assembly 12.

The crank frame assembly 62 includes an elongated crossbar 80 with a first portion 82 and a second portion 84. The crossbar first portion 82 and the crossbar second portion 84 are each coupled to the axle rod first end 64 and are disposed substantially on opposites sides of the axle rod 60 longitudinal axis. In this configuration, force created when the crank assembly 30 is actuated is distributed to either side of the axle rod 60. As shown the crank frame assembly crossbar 80 is a generally straight member. It is, however, noted that the crank frame assembly crossbar 80 may be any shape, e.g. generally circular, as in a bull nose ring, so long as two portions are disposed substantially on opposites sides of the axle rod 60 longitudinal axis. The axle rod 60 is preferably coupled to about the center of the crank frame assembly crossbar 80. Further, in the embodiment shown, the crank frame assembly crossbar 80 is positioned over the axle rod first end 64. That is, the crank frame assembly crossbar 80 is a unitary member. In an alternate embodiment (not shown), the crank frame assembly crossbar 80 is a bifurcated member with the crossbar first portion 82 and second portion 84 divided by the axle rod 60.

In the disclosed embodiment, the crank frame assembly crossbar 80 is one of three generally straight, elongated members 80, 86, 88 that form a generally triangular frame. That is, in addition to the crank frame assembly crossbar 80 there is a first frame member 86, a second frame member 88. These three crank frame assembly members 80, 86, 88 are fixed to each other at their ends thereby forming a rigid generally triangular frame 89. The triangular frame is disposed in a plane that extends generally perpendicular to the axle rod 60 longitudinal axis and/or axis of rotation. Preferably, the crank frame assembly crossbar 80 has a length of between about 3.0 in. and 4.0 in., and more preferably 3.0 in. The crank frame assembly first and second members 86, 88 preferably have substantially the same length which is preferably between about 3.5 in. and 4.0 in., and more preferably 3.5 in. Thus, the triangular frame 89 is preferably an isosceles triangle.

The crank frame assembly 62 also includes a crank handle 90. The crank handle 90 extends from the vertex of the generally triangular frame opposing the crank frame assembly crossbar 80. The crank handle 90 is a rigid, L-shaped member having a lever arm 92 and a grip arm 94. The crank handle lever arm 92 is coupled to the crank frame assembly first and second frame members 86, 88 where they form a vertex. The crank handle lever arm 92 extends generally perpendicular to the axle rod 60 longitudinal axis and/or axis of rotation. The crank handle lever arm 92 preferably has a length that is about the same as the greatest radius on the basket assembly 20, as shown, the radius of the hub outer rims 42. The crank handle grip arm 94 extends generally parallel to the axle rod 60 longitudinal axis and/or axis of rotation, unless, as detailed below, the crank handle 90 is selectively rotatably. The grip arm 94 may include a grip 96, such as, but not limited to an ergonomically shaped rubber grip 96.

In this embodiment, the triangular frame 89 may include a collar 98 at the vertex of the generally triangular frame 89 opposing the crank frame assembly crossbar 80. The collar 98 is a tubular member having an axis extending generally perpendicular to the axis of rotation of the barrel 22. In this configuration, the crank handle 90 may be coupled to the triangular frame 89 by passing the distal end of the crank handle lever arm 92 through the collar 98. The crank handle 90 may be fixed to the collar 98, or, selectively rotatable. That is, the crank handle 90 may be moved between two locked positions, a first position for use, wherein the grip arm 94 extends generally parallel to the axis of rotation of the barrel 22, and a second storage position wherein the crank handle 90 rotates about ninety degrees in the collar 98 so that the grip arm 94 extends generally perpendicular to the axis of rotation of the barrel 22. The crank handle 90 may be selectively rotatably coupled to the collar 98 by, for example, having a plurality of openings (not shown) in the crank handle lever arm 92 and the collar 98 and using a cotter pin or spring pin (neither shown) to secure the elements together.

Alternately, the crank handle 90 may have a lever arm 92 with a substantially reduced length, or may be absent altogether, and the function of the crank handle lever arm 92 may be performed by an extended triangular frame 89. That is, the crank frame assembly first and second members 86, 88 may have a length which is about the same as, or slightly greater than, the radius of the hub outer rims 42. If the crank handle lever arm 92 is absent, the axis of the collar 98 may extend generally parallel to the axis of rotation of the barrel 22.

The crank assembly 30 may further include an indicia plate 100. The indicia plate 100 is a generally flat plate structured to be disposed within the triangular frame 89. The indicia plate 100 is further structured to have an indicia 102 thereon. The indicia 102 are selected from the group comprising letters, numbers, characters, symbols, logos, designs, images, and trademarks. If the indicia plate 100 is paper or metal, the indicia 102 would typically be painted, printed, etched or applied (as in a decal or sticker). If the indicia plate 100 is plastic, the indicia 102 would typically be painted, printed, etched or applied (as in a decal or sticker), as with a metal plate, or, the indicia 102 could be molded into the plastic or otherwise created along with the plastic. The indicia plate 100 may be coupled to the crank assembly 30 by either and external device (not shown) such as, but not limited to, an adhesive, fasteners, tie-wraps, or, the indicia plate 100 may include a mounting device (not shown) such as, but not limited to, tabs structured to be inserted into slots (not shown) on the crank assembly 30 or a clip molded into the indicia plate 100.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A crank for a hose reel, said hose reel having a frame assembly with a rotatable basket, said basket having a generally cylindrical barrel with a hub disposed at each end, each said hub being generally circular and having a radius, said basket structured to rotate about a longitudinal axis, and wherein one said hub is structured to be coupled to a crank, said crank comprising:

an elongated axle rod having first end and a second end;

said axle rod second end structured to be coupled to said hub with the axle rod axis substantially aligned with said basket axis of rotation;

a crank frame assembly having an elongated crossbar with a first portion and a second portion; and said crossbar first portion and said crossbar second portion each coupled to said axle rod and disposed substantially on opposites sides of the axle rod longitudinal axis.

2. The crank of claim 1 wherein said crank frame assembly crossbar first portion and said crossbar second portion are each fixed to said axle rod.

3. The crank of claim 2 wherein said crank frame assembly crossbar is a generally straight member.

4. The crank of claim 2 wherein said crank frame assembly crossbar is a unitary member.

5. The crank of claim 1 wherein:

said crank frame assembly further includes an elongated first frame member and an elongated second frame member;

said crank frame assembly first frame member, said crank frame assembly second frame member and said crank frame assembly crossbar being coupled to each other and defining a generally triangular frame; and wherein said triangular frame is disposed in a plane that extends generally perpendicular to said axle rod longitudinal axis.

6. The crank of claim 5 wherein said crank frame assembly includes a crank handle, said crank handle coupled to said triangular frame at the vertex of the generally triangular frame opposing the crank frame assembly crossbar.

7. The crank of claim 6 wherein:

said crank frame assembly crank handle includes a lever arm and a grip arm;

said crank handle lever arm extends generally perpendicular to the axle rod longitudinal axis; and said crank handle grip arm extends generally parallel to the axle rod longitudinal axis.

8. The crank of claim 7 wherein said crank handle lever arm has a length that is about the same as the greatest radius on the basket assembly.

9. The crank of claim 5 wherein:

said crank assembly include an indicia plate, said indicia plate having an indicia thereon; and said indicia plate disposed within said triangular frame.

10. The crank of claim 9 wherein said indicia are selected from the group comprising: letters, numbers, characters, symbols, logos, designs, images, and trademarks.

11. A hose reel comprising:

a frame assembly with a rotatable basket;

said basket having a generally cylindrical barrel with a hub disposed at each end, each said hub being generally circular and having a radius;

said basket structured to rotate about a longitudinal axis, and wherein one said hub is structured to be coupled to a crank;

said crank having an elongated axle rod and a crank frame assembly;

said elongated axle rod having first end and a second end;

said axle rod second end structured to be coupled to said crank hub with the axle rod axis substantially aligned with said basket axis of rotation;

a crank frame assembly having an elongated crossbar with a first portion and a second portion;

said crossbar first portion and said crossbar second portion each coupled to said axle rod and disposed substantially on opposites sides of the axle rod longitudinal axis.

12. The hose reel of claim 11 wherein said crank frame assembly crossbar first portion and said crossbar second portion are each fixed to said axle rod.

13. The hose reel of claim 12 wherein said crank frame assembly crossbar is a generally straight member.

14. The hose reel of claim 12 wherein said crank frame assembly crossbar is a unitary member.

15. The hose reel of claim 11 wherein:

said crank frame assembly further includes an elongated first frame member and an elongated second frame member;

said crank frame assembly first frame member, said crank frame assembly second frame member and said crank frame assembly crossbar being coupled to each other and defining a generally triangular frame; and wherein said triangular frame is disposed in a plane that extends generally perpendicular to said axle rod longitudinal axis.

16. The hose reel of claim 15 wherein said crank frame assembly includes a crank handle, said crank handle coupled to said triangular frame at the vertex of the generally triangular frame opposing the crank frame assembly crossbar.

17. The hose reel of claim 16 wherein:

said crank frame assembly crank handle includes a lever arm and a grip arm;

said crank handle lever arm extends generally perpendicular to the axle rod longitudinal axis; and said crank handle grip arm extends generally parallel to the axle rod longitudinal axis.

18. The hose reel of claim 17 wherein said crank handle lever arm has a length that is about the same as the greatest radius on the basket assembly.

19. The hose reel of claim 15 wherein:

said crank assembly include an indicia plate, said indicia plate having an indicia thereon; and said indicia plate disposed within said triangular frame.

20. The hose reel of claim 19 wherein said indicia are selected from the group comprising: letters, numbers, characters, symbols, logos, designs, images, and trademarks.

* * * * *

UNITED STATES PATENT AND TRADEMARK OFFICE

CERTIFICATE OF CORRECTION

PATENT NO. : 8,196,852 B2
APPLICATION NO. : 12/558648
DATED : June 12, 2012
INVENTOR(S) : Greg Blaszczak It is certified that error appears in the above-identified patent and that said Letters Patent is hereby corrected as shown below:

Title page, Item [57], line 4, "of on of" should read --of one of--.
Column 1, line 37, "is expose to" should read --is exposed to--.
Column 2, line 24, "adjacent self" should read --adjacent shelf--.
Column 4, line 21, "opposites" should read --opposite--.
Column 4, line 28, "opposites" should read --opposite--.
Column 4, line 67, "selectively rotatably" should read --selectively rotatable--.
Column 5, line 45, "either and" should read --either an--.
Column 6, line 8, "opposites" should read --opposite--.
Column 6, line 43, "include" should read --includes--.
Column 6, line 67, "opposites" should read --opposite--.
Claim 19, Column 8, line 14, "include" should read --includes--.

Signed and Sealed this
Twenty-sixth Day of February, 2013

Teresa Stanek Rea
*Acting Director of the United States Patent and Trademark Office*